US011910911B2

(12) United States Patent
Benjelloun et al.

(10) Patent No.: US 11,910,911 B2
(45) Date of Patent: Feb. 27, 2024

(54) COMPACT ORAL CARE SYSTEM WITH INTEGRATED DISPENSING MECHANISM FOR INTERCHANGEABLE TOOTHBRUSH HEAD, TOOTHPASTE CARTRIDGE, AND INTERDENTAL BRUSH

(71) Applicants: Faycal Benjelloun, Weston, FL (US); Francisco Alberto Diaz, Lake Worth, FL (US)

(72) Inventors: Faycal Benjelloun, Weston, FL (US); Francisco Alberto Diaz, Lake Worth, FL (US)

( * ) Notice: Subject to any disclaimer, the term of this patent is extended or adjusted under 35 U.S.C. 154(b) by 0 days.

(21) Appl. No.: 17/890,499

(22) Filed: Aug. 18, 2022

(65) Prior Publication Data

US 2023/0055920 A1 Feb. 23, 2023

Related U.S. Application Data

(60) Provisional application No. 63/235,459, filed on Aug. 20, 2021.

(51) Int. Cl.

| | |
|---|---|
| ***A46B 11/00*** | (2006.01) |
| ***A46B 5/00*** | (2006.01) |
| ***A46B 17/04*** | (2006.01) |

(52) U.S. Cl.

CPC ..... *A46B 11/001* (2013.01); *A46B 5/0095* (2013.01); *A46B 17/04* (2013.01); *A46B 11/002* (2013.01); *A46B 11/0065* (2013.01); *A46B 2200/108* (2013.01)

(58) Field of Classification Search

CPC ..... A46B 11/001; A46B 5/0095; A46B 17/04; A46B 2200/108; A46B 11/00; A46B 11/0017; A46B 11/002; A46B 11/0024; A46B 11/0065; A46B 11/0096

USPC ..... 401/269, 270, 271, 278, 282, 188 R

See application file for complete search history.

(56) References Cited

U.S. PATENT DOCUMENTS

| | | | | |
|---|---|---|---|---|
| 5,909,977 | A | 6/1999 | Kuo | |
| 7,244,073 | B2 | 7/2007 | Trocino | |
| 7,528,717 | B2 | 5/2009 | Benjelloun | |
| 8,506,196 | B2 | 8/2013 | Boyd | |
| 2007/0183838 | A1 | 8/2007 | Umar | |
| 2012/0301209 | A1* | 11/2012 | Fattori | A46B 11/0065 15/167.1 |
| 2022/0295969 | A1* | 9/2022 | Robayo Arroyo | A46B 17/04 |

FOREIGN PATENT DOCUMENTS

| | | | |
|---|---|---|---|
| DE | 202004008909 | U1 | 9/2004 |

* cited by examiner

*Primary Examiner* — David J Walczak

(57) ABSTRACT

An all-in-one oral care system that includes a brush, a main body, a top cover, a bottom cover, an interdental brush, and a toothpaste cartridge. All major components are designed to be detachable and replaceable using attachment mechanisms built into each part. The oral care system utilizes a manual actuator to force toothpaste from the main body into the toothbrush head and onto the bristles when depressed. When released, the actuator creates a vacuum force that draws toothpaste from the cartridge into the main body. The vacuum force draws a plunger in the cartridge upwards to move the toothpaste to the main body.

18 Claims, 12 Drawing Sheets

COMPACT ORAL CARE SYSTEM WITH INTEGRATED DISPENSING MECHANISM FOR INTERCHANGEABLE TOOTHBRUSH HEAD, TOOTHPASTE CARTRIDGE, AND INTERDENTAL BRUSH

FIELD OF THE INVENTION

The present invention relates generally to an all-in-one oral care system. More specifically, the present invention integrates a toothpaste dispensing mechanism and provides an interchangeable toothbrush, a tongue scraper, a toothpaste cartridge, and an interchangeable interdental brush in other embodiments.

BACKGROUND OF THE INVENTION

Tooth brushing is the act of scrubbing teeth with a toothbrush with toothpaste for oral hygiene. Floss or interdental brushes can be utilized to remove food and dental plaque from teeth in areas the toothbrush is unable to reach. Although dental care is an essential procedure for keeping the mouth and teeth clean, carrying the toothbrush, toothpaste, and dental floss or interdental brush altogether can be a burden. Therefore, a need exists for a novel all-in-one oral care system that is lightweight and functionally reliable.

An objective of the present invention is to provide a lightweight oral care system with easily interchangeable parts that can quickly be accessed, deployed, and used on-the-go, on travel, anywhere, anytime. Another objective of the present invention is to include an interchangeable cartridge containing toothpaste, an interchangeable toothbrush, and a tongue scraper.

A user of the present invention can utilize the toothpaste dispensing mechanism and visualize both flavor and level of toothpaste remaining in the cartridge through a transparent window on the bottom cover. In other embodiments, the present invention further comprises an interchangeable interdental brush. Additional features and benefits are further discussed in the sections below.

SUMMARY OF THE INVENTION

The present invention provides a unique oral care system. The present invention enables the user to access a ready-to-use, all-in-one oral care system without having to carry a separate tube of toothpaste or a toothbrush or a tongue scraper. The present invention features both an interchangeable cartridge that contains toothpaste and an interchangeable toothbrush head with an integrated tongue scraper. Toothpaste is dispensed upon actuating the airless pump mechanism located on the main body and supported by other components and sub-assemblies within the system. The toothpaste dispenser is manually actuated through a silicone actuator on the main body of the unit. The toothbrush head comprises a plurality of bristles for manual brushing. The unique design of the present invention attends to both user interface requirements for comfort and user experience preferences for both convenience and satisfaction. Also, the present invention features a bottom cover that provides the end-user with a visual of both flavor name and level of toothpaste remaining in the cartridge.

In a preferred embodiment, the present invention comprises a main body, a toothbrush, a bottom cover, a top cover, and a cartridge. All of the components of the present invention are designed to mount, snap or latch onto one another in a keyed fashion, without the use of any additional hardware. The applied Design for Manufacturing (DFM) approach makes the present invention assembly easy, fast, and cost-effective. It also enables the end-user to easily replace or interchange the components that require renewal once their end of life is reached, namely the toothbrush head and tongue scraper, the cartridge, and the interdental brush. In the preferred embodiment, all components feature materials that are either biodegradable or recyclable.

DETAILED DESCRIPTIONS OF THE INVENTION

Figure 1:
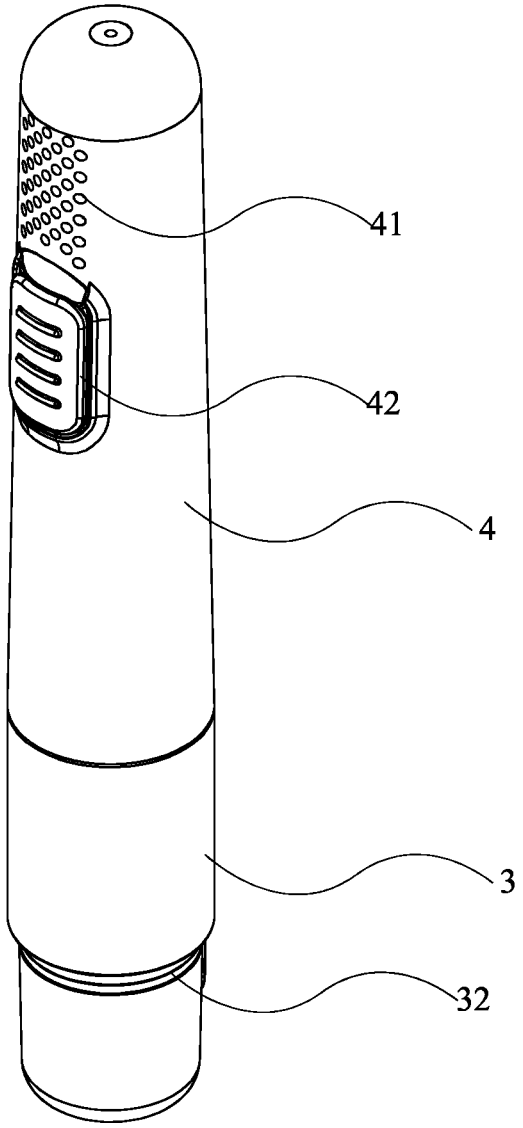
FIG. 1 is a top front perspective view of the present invention fully assembled.
Figure 2:
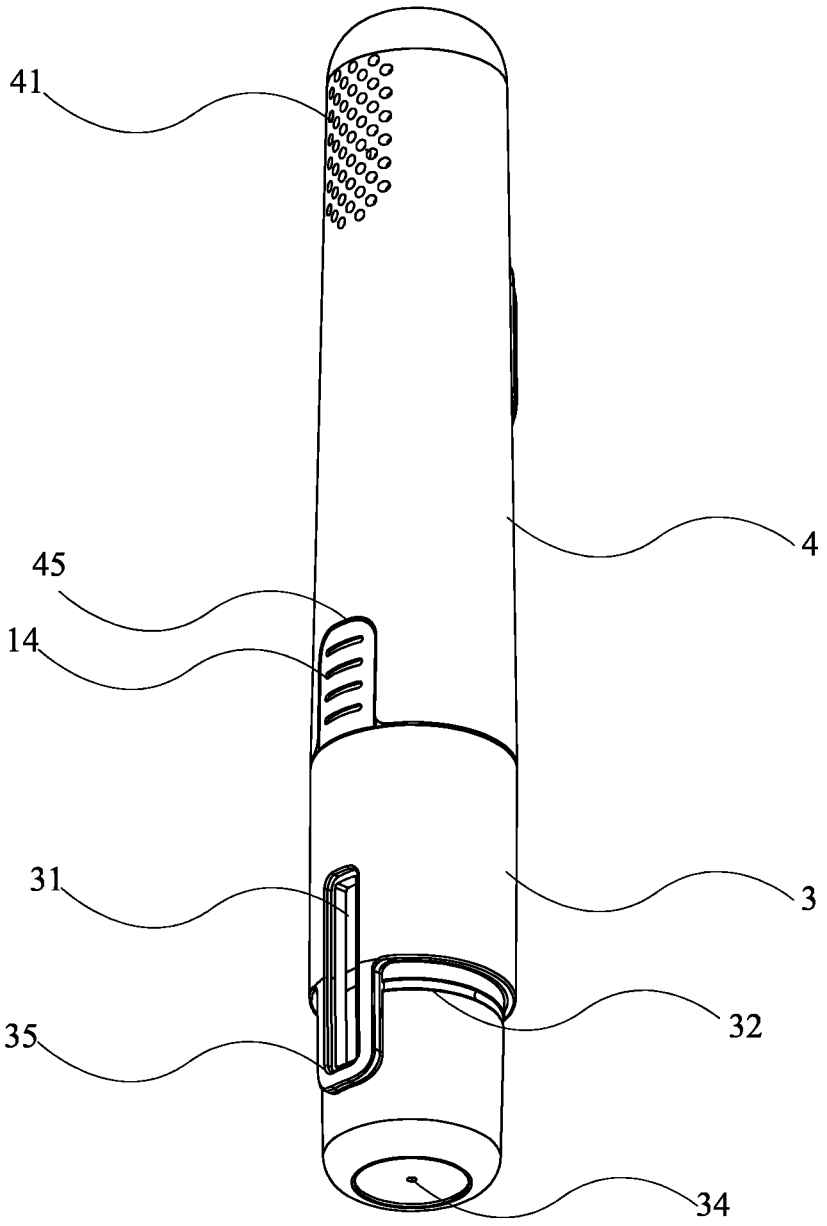
FIG. 2 is a bottom rear perspective view of the present invention fully assembled.

All illustrations of the drawings are for the purpose of describing selected versions of the present invention and are not intended to limit the scope of the present invention. The word "resilient" in this document should be construed to mean that the associated material or part is designed to return to its initial state after being deformed. The phrase "press-fit" in this document should be construed to mean that the associated component is designed to be held in place by friction and normal forces against other components.

The present invention is an all-in-one oral care system that comprises a main body 1, a toothbrush head 2, a bottom cover 3, a top cover 4, a cartridge 5, and an interdental brush 42

The main body 1 further comprises an actuator 11, inner walls 12, and a body channel 121 formed by the inner walls 12. The main body 1 further comprises a variety of attachment features for connecting to the other parts of the system, including a back slot 131, a plurality of protrusions 132, a notch 133, a neck connector 134, and a cover receiving groove 135. The main body 1 has a small personalization piece 14 on the back.

The toothbrush head 2 comprises an arm 21 made of thermoplastic, a tongue scraper 211 that comprises a silicone pad with a plurality of raised notches 212, a toothbrush channel 22 within the toothbrush head 2, an over-molded valve 23 that further comprises a nozzle 231, a plurality of brushing bristles 24, a tab 25 that serves as an attachment mechanism to the back slot 131 of the main body 1, and a receiving hole 26 for connecting to the neck connector 134 of the main body 1.

The bottom cover 3 comprises a visual window 31, a snap-on provision 32 for connection with the top cover 4, a plurality of attachment grooves 33 for connection with the plurality of protrusions 132 on the main body 1, a bottom hole 34, an extended window piece 35, and a hollow interior sized to accommodate the cartridge 5.

The top cover 4 comprises a plurality of ventilation holes 41, an interdental brush 42, a receptacle 43 for the interdental brush 42, and a raised surface 44 for connecting the top cover 4 to the bottom cover 3.

The cartridge 5 comprises a cartridge body 57, a gasket 51, a plunger 52, a cap 53 that includes a cap hole 55 at the base of the cap 53, and toothpaste 54.

Figure 3:
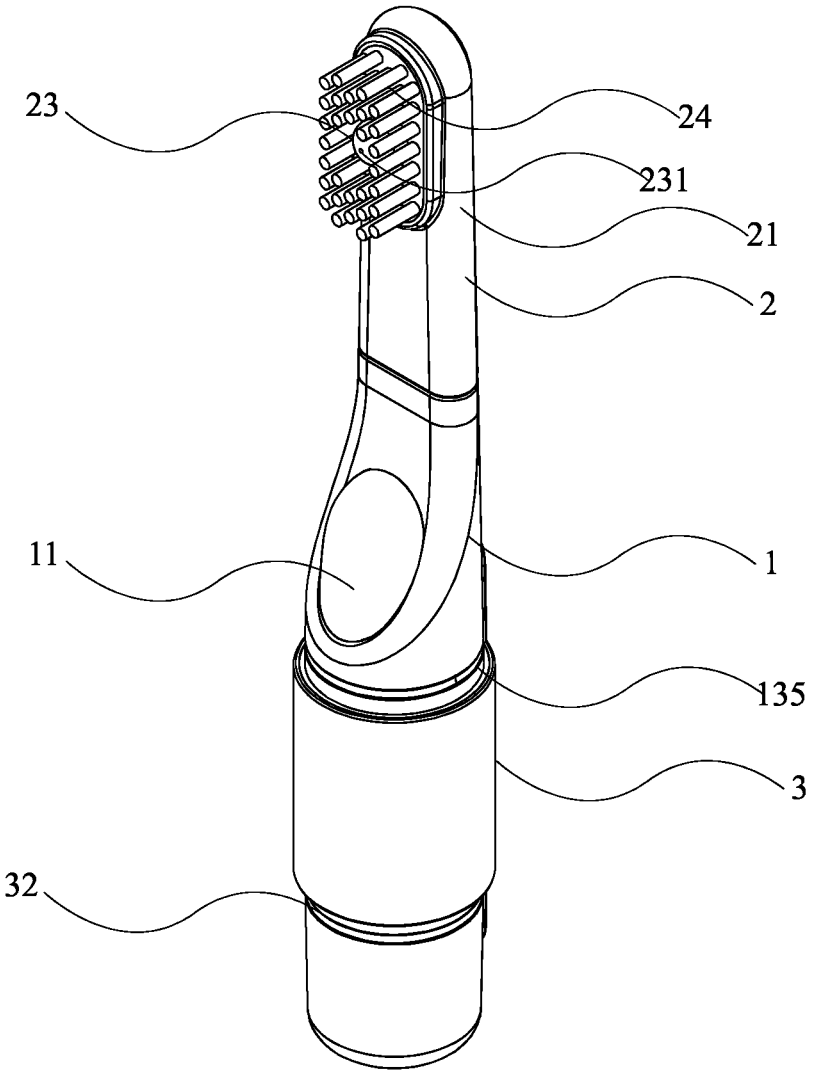
FIG. 3 is a top front perspective view of the present invention with the top cover removed.
Figure 4:
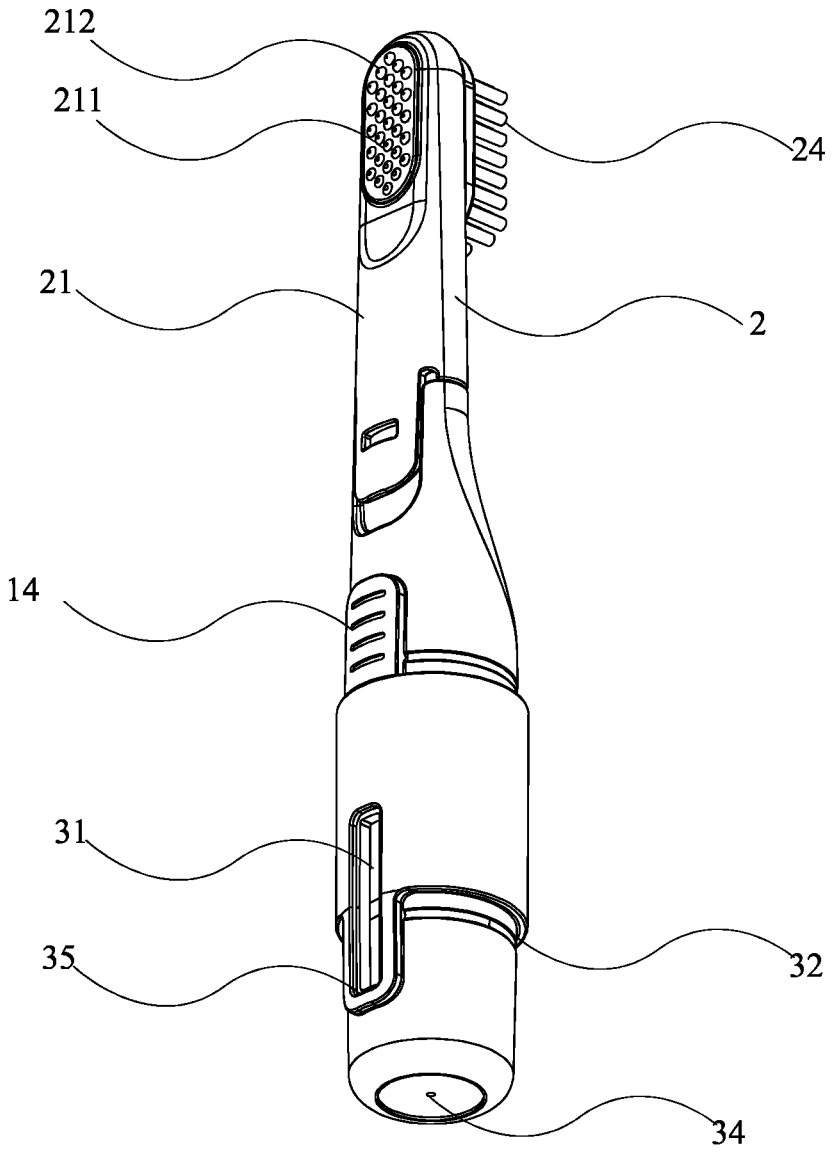
FIG. 4 is a bottom rear perspective view of the present invention with the top cover removed.
Figure 5:
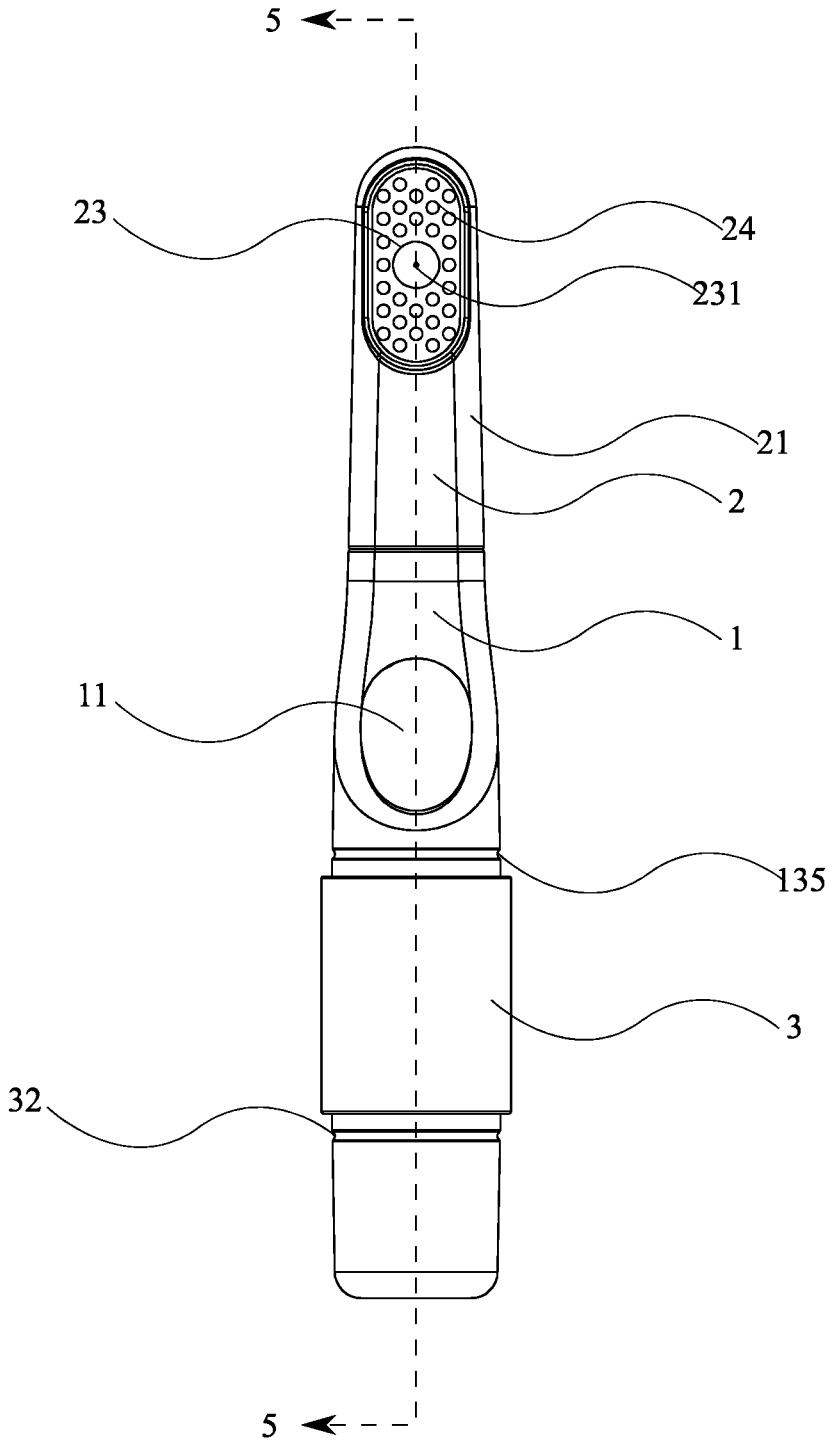
FIG. 5 is a front view of the present invention with the top cover removed.
Figure 6:
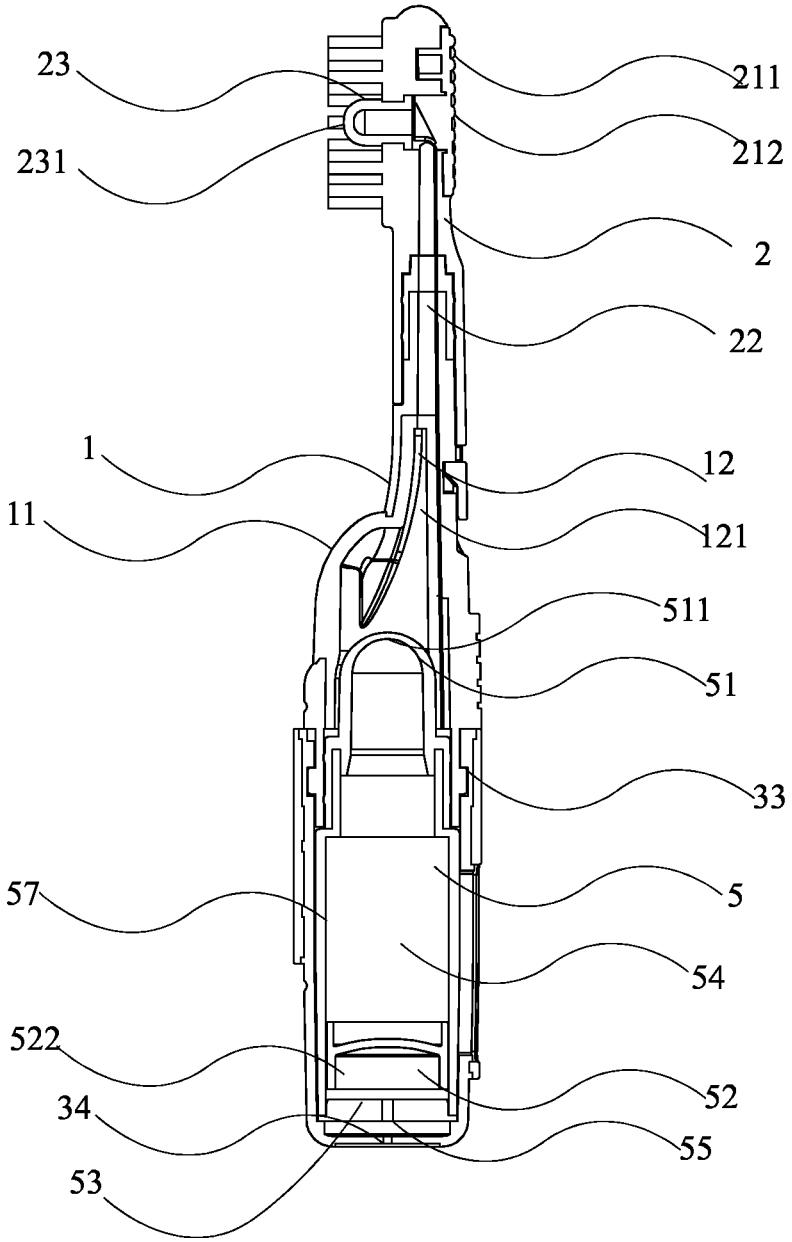
FIG. 6 is a vertical cross-sectional view of FIG. 5 taken along line 5-5 of FIG. 5.
Figure 7:
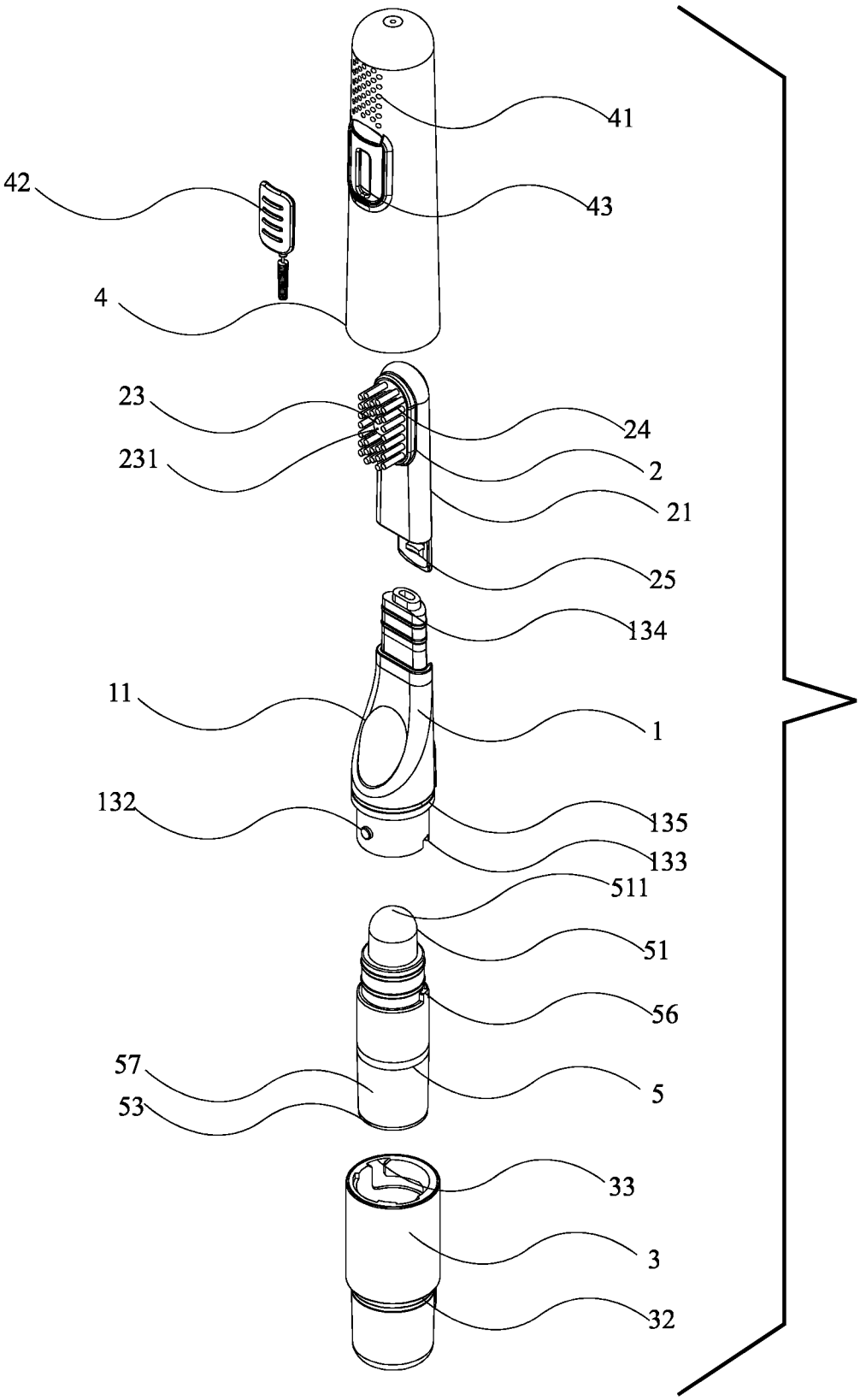
FIG. 7 is a top front exploded view of the present invention.
Figure 8:
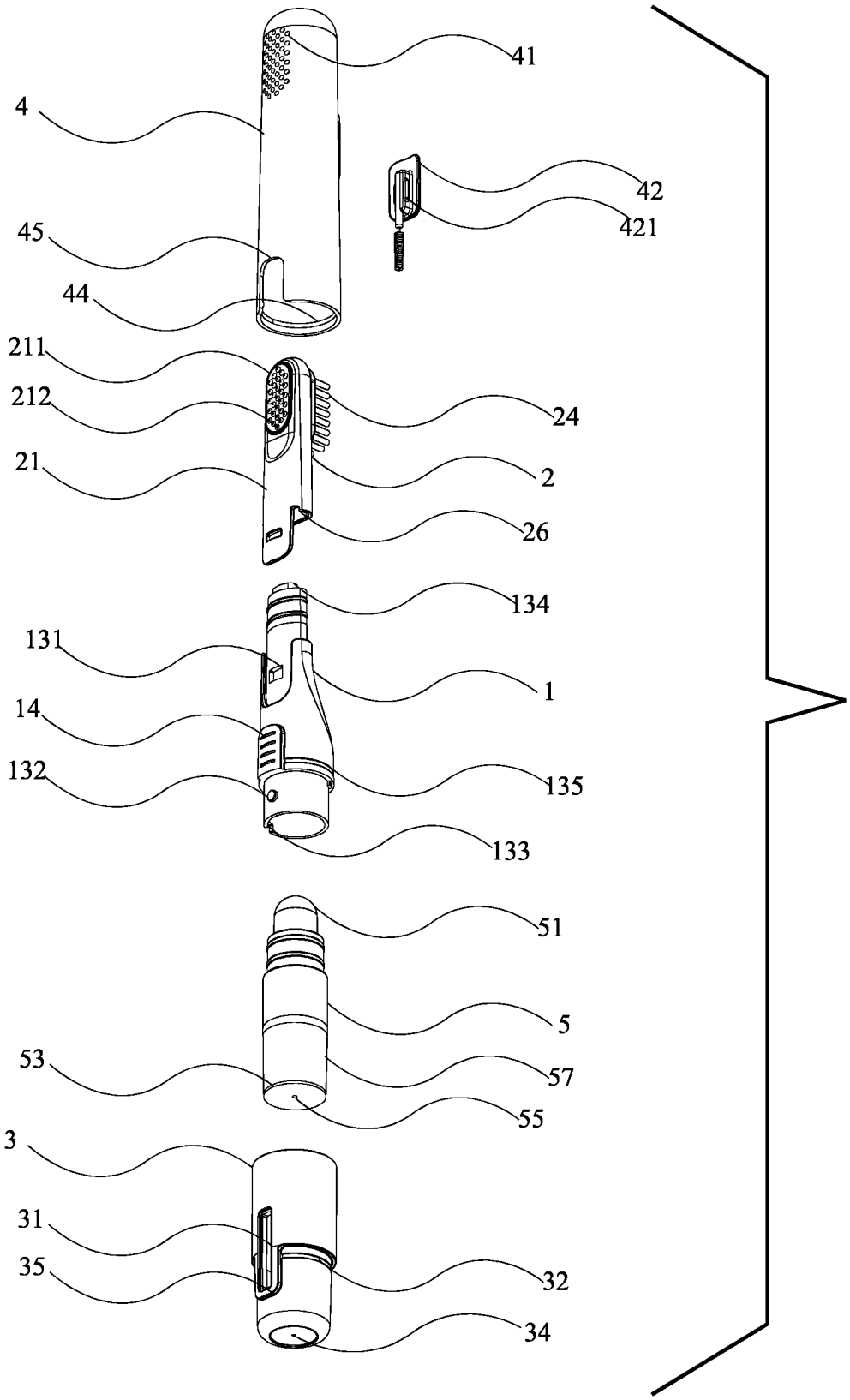
FIG. 8 is a bottom rear exploded view of the present invention.
Figure 9:
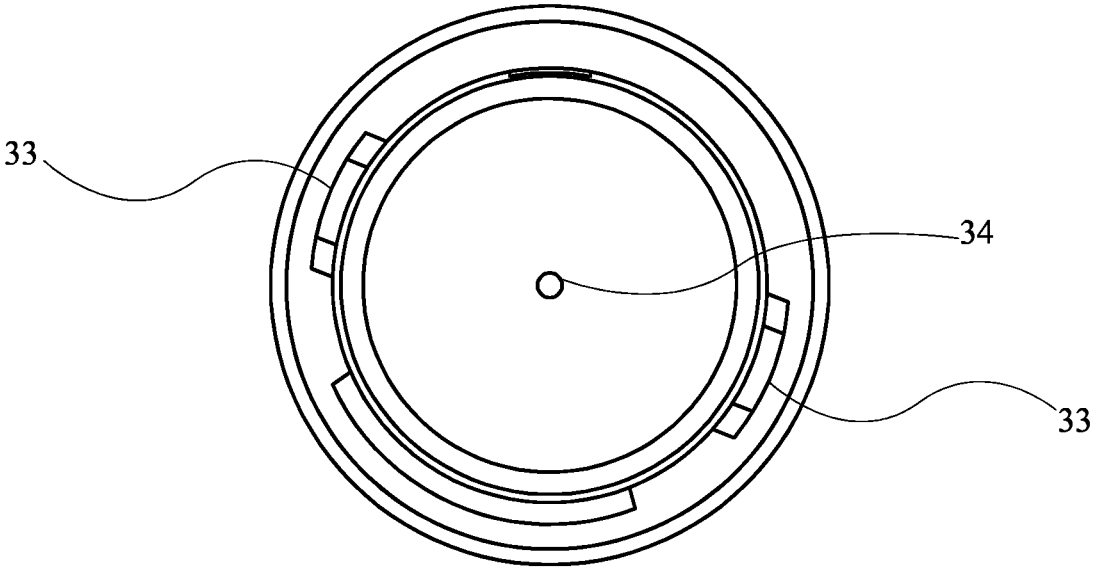
FIG. 9 is a top-down view of the bottom cover.
Figure 10:
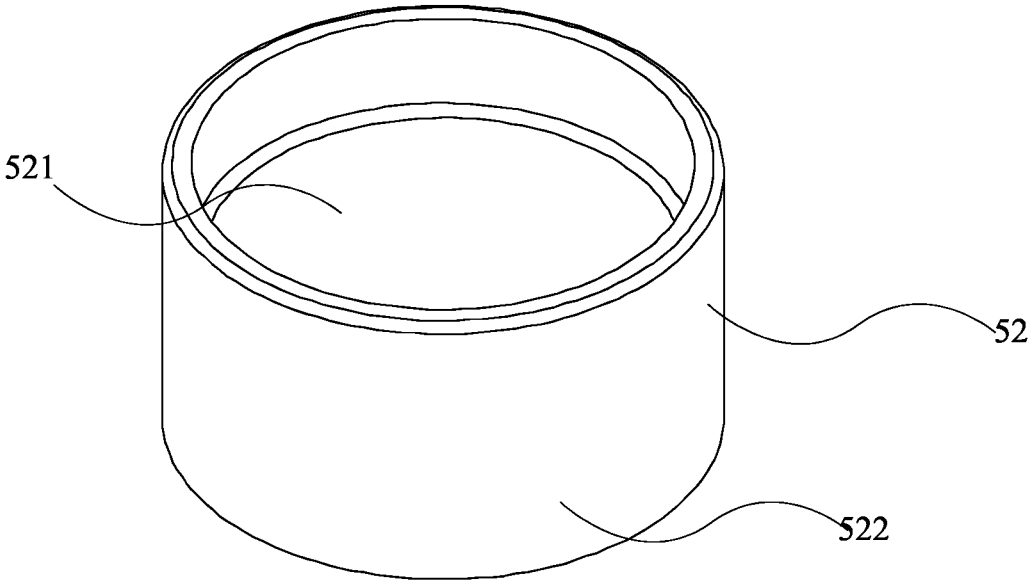
FIG. 10 is a top front perspective view of the plunger.
Figure 11:
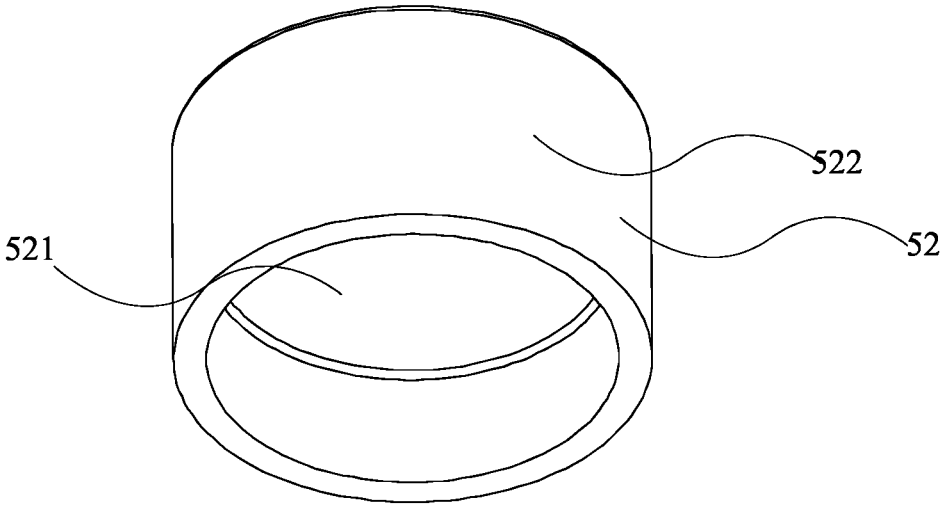
FIG. 11 is a bottom rear perspective view of the plunger.

Referring now to the figures, FIGS. 3-5 show the main body 1 in detail as attached to the bottom cover, FIG. 6 shows a cross-sectional view of the internals of the main body 1, and FIGS. 7 and 8 show the main body 1 in an exploded view arranged with the other components. The main body 1 features an oval-shaped over-molded silicone rubber-based actuator 11. The actuator's 11 geometry, durometer, and orientation are designed to help generate a sufficient force to dispense a fixed amount of toothpaste 54 upon every single actuation. This is achieved using silicone as a material, which gives the actuator 11 resilient properties, allowing the actuator 11 to return to its initial state after being deformed. This allows the actuator 11 to be pressed with sufficient force to press against the body channel 121, forcing the toothpaste 54 in the body channel out the the nozzle 231. As the actuator 11 returns to the actuator's 11 initial shape, the plunger 52 is pulled up by the resulting vacuum force created.

The inner walls 12 of the thermoplastic-based main body 1 are covered with over-molded silicone rubber to form an internal geometry of a narrow body channel 121. The narrow body channel 121 is designed to be in fluid communication with the toothbrush channel 22 (which is in turn in fluid communication with the nozzle 231) and the cartridge 5, such that the body channel 121 enables passage of air and toothpaste 54 upon actuation. In some embodiments, the body channel 121 is the same circumference as the cartridge nozzle 511.

On the back of the main body 1, a small personalization piece 14 is provided. The personalization piece 14 is sized to press-fit into the receiving slot 45 on the top cover 4. This area can be used as a surface for a user or manufacturer to attach stickers or mold in designs to improve the aesthetics or uniqueness of the present invention.

The main body 1 also includes attachment features that support the mounting of all other components and sub-assemblies. No hardware is required to assemble or disassemble the oral care system per design intent, as the attachment features are designed to integrate with only basic alignment and force supplied by the user. The attachment features include a back slot 131, a plurality of protrusions 132, a receiving notch 133, a neck connector 134, and a cover receiving groove 135.

First, the main body 1 comprises a back slot 131 that connects the toothbrush head 2 to the main body 1. The back slot 131 is an indent located on the rear of the main body 1 and is designed such that the tab 25 of the toothbrush head 2 slots into the indent of the back slot 131.

Second, the main body 1 comprises a plurality of protrusions 132 located on bottom of the main body 1. This plurality of protrusions 132 is designed to slide into the plurality of attachment grooves 33 on the bottom cover 3. The plurality of protrusions 132 is designed to slide into the plurality of grooves 33 and then rotate to lock the main body 1 into place with the bottom cover 3. Then, the main body 1 and bottom cover 3 cannot be disassembled until the user rotates the plurality of grooves 33 again and lifts the plurality of protrusions 132 along the proper path.

Third, the main body 1 comprises a receiving notch 133. The receiving notch 133 aligns with the alignment notch 56 on the cartridge 5 to ensure proper orientation of the cartridge 5 with the main body 1 to allow proper fluid communication between the two parts, ensure proper flow of the toothpaste 54 through the main body 1, and align the printed flavor name on the cartridge 5 with the visual window 31 on the bottom cover 3.

Fourth, the main body 1 comprises a neck connector 134. The neck connector 134 extends upwards from the body and is designed to press-fit into the receiving hole 26 on the toothbrush head 2.

Fifth, the main body 1 comprises a cover receiving groove 135. The cover receiving groove 135 is a small indent that runs circumferentially around the main body 1. The cover receiving groove 135 is designed to have a depth equal to the height of the raised surface 44 on the top cover 4. Thus, the top cover 4 can attach to the main body 1 by slotting the raised surface 44 into the cover receiving groove 135.

As can be seen in FIGS. 3-5, 7, and 8, in the preferred embodiment, the toothbrush head 2 is an interchangeable sub-assembly that is freely attachable and detachable from the main body 1. The toothbrush head 2 includes an arm 21 comprised of a thermoplastic-based material that features an over-molded silicone rubber-based toothbrush channel 22. The toothbrush head 2 also includes an over-molded valve 23 that features a nozzle 231. The toothbrush channel 22 is designed to be in fluid communication with the nozzle 231 and the body channel 121. The nozzle 231 connects in fluid communication with the toothbrush channel 22 to serve the dispensing function—when the actuator 11 is pressed, the toothpaste 54 will flow from the cartridge 5, into the body channel 121 of the main body 1, through the toothbrush channel 22 of the toothbrush head 2, and out the nozzle 231. The over-molded valve 23 is surrounded by a plurality of brushing bristles 24. A silicone pad 211 with a plurality of raised notches 212 located on the arm's upper end serves as a tongue scraper.

The toothbrush head 2 sub-assembly seamlessly integrates the main body 1 via the tab 25. The tab 25 is comprised of a rigid, resilient yet flexible material (such as polypropylene) to allow the tab 25 to bend and flex without breaking. When the tab 25 is slid over back slot 131 in the main body 1, the tab 25 will flex up over the main body 1, and snap into the back slot 131. For removal, an ample applied force will cause the tab 25 to flex upwards and be removed from the back slot 131.

Figure 12:
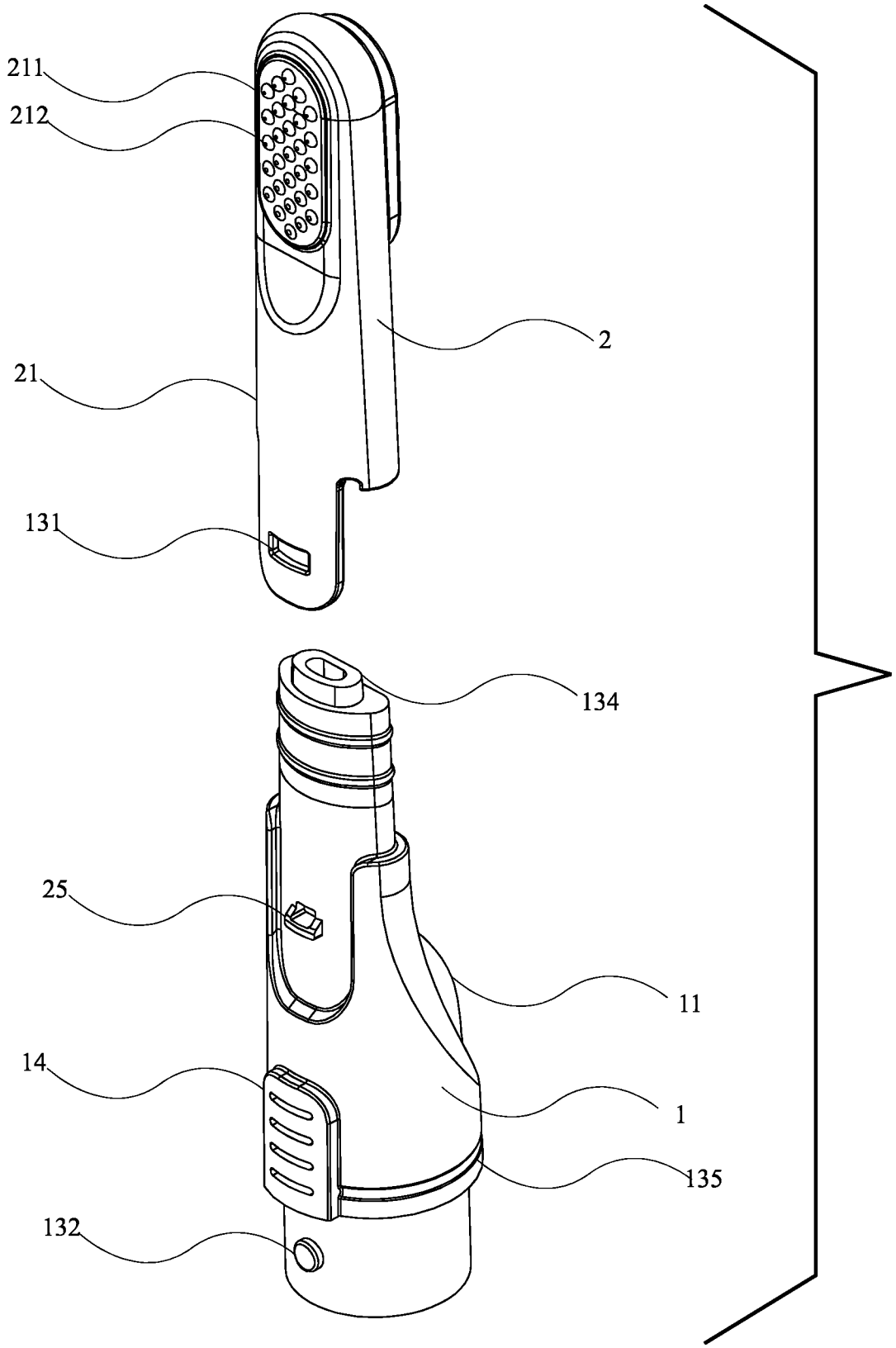
FIG. 12 is a top rear perspective exploded view of an alternate embodiment of the toothbrush head and main body, where the back slot and tab positions are swapped.

In an alternate embodiment as seen in FIG. 12, the tab 25 and back slot 131 may be in reversed positions. For example, the tab 25 may instead be located on the main body 1, and the back slot 131 may be located on the toothbrush head 2. In this alternate embodiment, the back slot 131 on the toothbrush head 2 flexes to snap over the tab 25 on the main body 1. Other similar changes to the placement or geometry of the other attachment mechanisms of the all-in-one oral care system are considered within the spirit and scope of the invention.

This connection method of the tab 25 and back slot 131 allows the toothbrush head 2 to be easily attached and removed from the main body 1 as needed by the user. For example, once the bristles are frayed, the end user can easily remove and replace the toothbrush head 2 sub-assembly only, thereby preserving the overall packaged system. The toothbrush head 2 sub-assembly is designed to be crafted of a material that is either biodegradable or recyclable.

In the preferred embodiment, the bottom cover 3 is mounted on the main body 1. The bottom cover 3 secures the cartridge 5 in place and serves as a grip—the hollow interior of the bottom cover 3 allows the cartridge 5 to be inserted inside the bottom cover 3. As can be seen in FIGS. 1-9, the bottom cover 3 features a visual window 31 that is transparent or translucent, enabling the user to identify the flavor name of the toothpaste 54 and to monitor the toothpaste 54 level in the cartridge 5 at any time. The bottom cover 3 can be removed from the main body 1 to replace the cartridge 5 when needed and easily mounted back on the present invention once a new cartridge 5 is installed. The bottom cover 3 is designed to mount on the main body 1 using the plurality of attachment grooves 33 located on the bottom cover 3. In the ideal embodiment, the plurality of attachment grooves 33 have an l-shape. The plurality of attachment grooves 33 is designed so that the plurality of protrusions 132 on the main body 1 slides straight down the vertical part of the plurality of attachment grooves 33, and then rotates into the narrow horizontal part of the plurality of attachment grooves 33 to lock the bottom cover 3 into place with the main body 1. The bottom cover 3 is designed to be removed via the same sequence in reverse, by rotating the plurality of protrusions 132 and then lifting straight upwards.

The bottom cover 3 also includes a snap-on provision 32 that allows the top cover 4 to be used as a handle. The snap-on provision 32 is a groove that is designed to have a depth equivalent to the height of the raised surface 44 of the top cover 4, so that the raised surface 44 slides into the snap-on provision 32. In this way, the top cover 4 can be attached to the bottom cover 3, allowing the top cover 4 to be used as an extended handle for the oral care system. The bottom cover 3 further includes the extended window piece 35. The extended window piece 35 allows nearly the entirety of the cartridge 5 to be seen through the visual window 31. The extended window piece 35 is designed to be the same size as the receiving slot 45 on the top cover 4, such that the extended window piece 35 can press-fit into the receiving slot 45 to allow the parts to better connect when the snap-on provision 32 is connected to the raised surface 44 on the top cover 4.

The bottom cover 3 further contains a bottom hole 34 on the bottom of the bottom cover 3. This bottom hole 34 allows air to enter into the inside of the bottom cover 34 and through the cap hole 55 in the bottom of the cartridge 5 when the actuator 11 is used.

As can be seen in FIGS. 1-2 and FIGS. 7-8, in the preferred embodiment, the top cover 4 is a semi-translucent, slightly opaque, or somewhat frosted or textured part that serves several functions. The top cover 4 is used foremost as a cover for the present invention when it is not being used or simply stored. The semi-opaque look helps identify the present invention as an oral care device and contributes to the aesthetic appeal of the product. The top cover 4 also features a plurality of ventilation holes 41 that help prevent bacteria and germs from building up around the bristles and the tongue scraper. The top cover 4 further comprises a receptacle 43 intended to receive the interdental brush 42. The interdental brush 42 has flexible, resilient flanges 421 on the rear. The flanges 421 are designed to compress or flex inwards when the interdental brush 42 is pushed into the receptacle 43. Once the flanges 421 are pushed through the receptacle 43, they expand to their original shape, keeping the interdental brush 42 secured to the top cover 4. To remove the interdental brush 42, the user simply pulls the interdental brush 42, which causes the flanges 421 to compress or flex inwards, allowing the interdental brush 42 to be pulled free of the receptacle 43. The top cover 4 further comprises a raised surface 44. The raised surface 44 is designed to snap into the groove of the snap-on provision 32 of the bottom cover 3, allowing the top cover 4 to be used as an extended handle.

As can be seen in FIGS. 6-8, in the preferred embodiment, the cartridge 5 is a sub-assembly that comprises a cartridge body 57, an alignment notch 56, a cartridge gasket 51, a plunger 52, a cap 53 that features a cap hole 55, and toothpaste 54. The cartridge 5 is designed to seamlessly plug into the main body 1, such that the cartridge nozzle 511 of the gasket 51 is in fluid communication with the body channel 121 of the main body 1 to dispense toothpaste 54 upon actuation of the dispensing mechanism. The cartridge 5 uses an alignment notch 56 to serve as a keyed press-fit mechanism by slotting into the receiving notch 133 on the main body 1. The alignment notch 56 ensures the cartridge 5 is properly aligned with the main body 1, such that the cartridge 5 is properly in fluid communication with the main body 1. Additionally, the alignment notch 56 assures that the flavor name printed on the inside of the cartridge body 57 is properly visible through the visual window 31 on the bottom cover 3. The cartridge body 57 is transparent or translucent, such that the user can see into the cartridge body 57 and see the remaining toothpaste 54. The interior walls of the cartridge body 57 are designed to be a polished surface, such that they exert little friction against any adjacent surfaces. The cartridge 5 features an active toothpaste 54 volume that can support up to 30 brush sessions. The dispensed amount—in the ideal embodiment, being slightly larger than pea-sized—upon each actuation, is enough to support one complete brushing session according to the ADA and surveyed dentists. Once used up, the cartridge 5 can be easily removed and disposed of in an eco-friendly manner. The cartridge 5 sub-components are designed to be either biodegradable or recyclable. The cartridge 5 is designed to be interchangeable, allowing the user to select a new cartridge 5 selected from a pre-approved list. The featured toothpaste 54 is offered in various industry-approved ingredients and flavors. All featured toothpaste 54 will be supplied by established vendors who meet FDA requirements. The overmolded cartridge gasket 51 ensures a leakage-free assembly and eliminates postoperative assembly steps. The cartridge gasket 51 creates an airtight seal, apart from a cartridge nozzle 511 which allows fluid communication between the interior of the cartridge 5 and the main body 1. The cartridge gasket 51 also prevents the toothpaste 54 from getting exposed to air and drying when not in use. The bottom of the cartridge 5 comprises the cap 53. The cap 53 further comprises a cap hole 55 in the center of the cap 53.

The plunger 52 is designed to have a shaped top 521 and an outer wall 522. The outer wall 522 of the plunger 52 is designed to be polished, such that it exerts little friction against any adjacent surfaces. The plunger 52 is designed such that it is held in place inside the cartridge body 57 with a frictionless fit design, such that the atmospheric air pressure below the plunger 52 and the toothpaste 54 above the plunger 52 keep the plunger 52 from falling or moving when the system is not in use. The plunger 52 is held in place between actuations as follows: the volume above the plunger 52 is filled with toothpaste 54. When the actuator 11 on the main body 1 is being depressed (after being pressed by a user), an upwards pulling force that is greater than gravity is generated. As a result, the plunger 52 shifts upward within the cartridge body 57 along with the toothpaste 54 above it.

The polished surfaces of both the cartridge body 57 and plunger 52 prevent friction and resistance along the path of travel. Throughout this process, the cap hole 55 on the cap 53 allows for air intake below the plunger 52 to fill the void left as the plunger 52 moves upwards. Once the actuator 11 completely returns to its initial state, the force over the plunger 52 from above becomes zero while an upward force that is generated by the atmospheric pressure below the plunger 52 becomes relatively significant. That pressure differential helps keep the plunger 52 from dropping. In this way, the atmospheric pressure below the plunger 52 prevents it from dropping, while the polished surfaces of the cartridge body 57 and the outer wall 522 allow the plunger 52 to slide smoothly upwards when the actuator 11 is depressed.

The shaped top 521 of the plunger 52 is in contact with the toothpaste 54, such that when the plunger 52 moves upwards, the toothpaste 54 is forced out the cartridge nozzle 511 in the cartridge gasket 51. The design of the plunger 52 creates a small hollow area beneath the shaped top 521, such that air can enter the area beneath the plunger 52 from the cap hole 55. The shaped top 521 may be of any shape that provides an adequate surface area against the toothpaste 54 and ample area beneath the plunger 52 for air to flow. Such shapes may include a flat surface or a raised surface, though alternate shaping is considered within the spirit and scope of the present invention.

The present invention utilizes a non-pressurized vacuum dispensing mechanism that uses the actuator 11 on the main body 1 and the plunger 52 in the cartridge 5. When the oral care system is assembled, the embedded design provisions enable the airless pump to seamlessly draw the plunger 52 and thereby the toothpaste 54 from the cartridge 5 and drive the toothpaste 54 into the body channel 121, then into the toothbrush channel 22, and finally out through the nozzle 231 and onto the plurality of brushing bristles 24. The attachment features and components are arranged to enable the physics behind the airless pump mechanism to function properly, as described in the following paragraph.

The following describes how the actuator 11 works to draw the toothpaste 54 from the cartridge 5. The oval-shaped silicone rubber actuator 11 is critical to the proper function of the dispensing mechanism. The actuator's 11 geometry and silicone rubber material's hardness/durometer are particularly important, as the actuator 11 must be robust enough to provide sufficient force when pressed but must be resilient enough to return to its initial shape when released. By pressing the actuator 11, air and toothpaste 54 that are present inside the toothbrush channel 22, if any, are forced towards the nozzle 231 that is in the middle of the plurality of brushing bristles 24. The exit point of the toothpaste 54 consists of a nozzle 231 on the over-molded valve 23 that is surrounded by the plurality of brushing bristles 24. At this point, the fixed volume of air and toothpaste 54 that were present behind the oval-shaped actuator 11 have been pushed out. Upon releasing the actuator 11, the silicone rubber of the actuator 11, due to its inherent resilient properties, naturally seeks to return to its initial state, thereby acting as an airless pump. The release of the actuator 11 generates a vacuum force as the actuator 11 rises to its initial state, the vacuum force temporarily sealing the nozzle 231 on the toothbrush head 2 and pulling the plunger 52 inside the cartridge 5 towards the opening on the cartridge gasket 51 and dispensing the toothpaste 54 in the same direction in order to fill the vacuum that the ousted air had left behind. A subsequent actuation pushes up the toothpaste 54 further into the toothbrush channel 22 and eventually through the nozzle 231 on the toothbrush head 2, with new toothpaste 54 filling the void left in the body channel 121 as the vacuum force pulls the plunger 52 upwards. The cartridge 5 includes the cap hole 55 at base of the cartridge 5 to enable air intake as the plunger 52 shifts in the opposite direction, the cap hole 55 being aligned with the bottom hole 34 of the bottom cover 3. Air continues filling the space left underneath the plunger 52 as the plunger 52 shifts away from the plunger's 52 initial position. The plunger 52 retains the new position with a physics-based design as described above, where the atmospheric pressure beneath the plunger 52 prevents it from falling when not in use. The cartridge 5 materials of thermoplastic and silicone have properties and a geometry that ensure a reliable press-fit into the main body 1 so that the airless pump can function properly. The present invention does not need to be sitting upright for the airless pump mechanism to work. The present invention functions in any orientation. In some embodiments, the actuator 11 is in contact with the body channel 121.

Although the invention has been explained in relation to its preferred embodiment, it is to be understood that many other possible modifications and variations can be made without departing from the spirit and scope of the invention. Further minor design changes relative to any component within the system may occur in order to optimize aspects of cost-effective manufacturability or production.

What is claimed is:

1. An all-in-one oral care system comprising:

a main body;

a toothbrush head;

a bottom cover;

a top cover;

a cartridge;

the main body comprising an actuator, inner walls, a body channel, a plurality of protrusions, a cover receiving groove, and a neck connector;

the actuator being made from a resilient material;

the toothbrush head comprising an arm, a toothbrush channel, an over-molded valve, a nozzle, a plurality of brushing bristles, and a receiving hole;

the bottom cover comprising a bottom hole, a snap-on provision, a visual window, and a plurality of attachment grooves;

the top cover comprising a raised surface;

the cartridge comprising a cartridge body, a cap, a cartridge gasket, a plunger, toothpaste, and a cap hole;

the cartridge gasket further comprising a cartridge nozzle;

the bottom cover comprising a hollow interior sized to accommodate the cartridge;

the inner walls of the main body forming the body channel;

the main body being detachably connected to the toothbrush head, wherein the neck connector slides into the receiving hole;

the main body being detachably connected to the bottom cover, wherein the plurality of protrusions on the main body slot into the plurality of attachment grooves on the bottom cover; and the top cover being detachably connected to the bottom cover, wherein the raised surface of the top cover snaps into the snap-on provision of the bottom cover.

2. The all-in-one oral care system of claim 1, wherein:

the body channel is the same circumference as the cartridge nozzle; and the actuator is in contact with the body channel.

3. The all-in-one oral care system of claim 1, further comprising:

a tab positioned on the arm of the toothbrush head;

a back slot positioned on the main body; and wherein the tab snaps into the back slot on the main body.

4. The all-in-one oral care system of claim 3, wherein the plunger comprises an outer wall and a shaped top.

5. The all-in-one oral care system of claim 1, wherein:

a tab is positioned on the main body; and a back slot is positioned on the arm of the toothbrush head.

6. The all-in-one oral care system of claim 5, further comprising:

an extended window piece on the bottom cover;

a receiving slot on the top cover; and the extended window piece detachably connecting into the receiving slot.

7. The all-in-one oral care system of claim 6, further comprising a personalization piece on the main body.

8. The all-in-one oral care system of claim 7, wherein the personalization piece is detachably connected into the receiving slot on the top cover.

9. The all-in-one oral care system of claim 1, further comprising a plurality of ventilation holes on the top cover.

10. The all-in-one oral care system of claim 9, further comprising:

a receptacle located on the top cover;

an interdental brush; and wherein the interdental brush is sized to fit within the receptacle on the top cover.

11. The all-in-one oral care system of claim 10, wherein:

the interdental brush further comprises flanges; and the flanges detachably connecting into the receptacle on the top cover.

12. The all-in-one oral care system of claim 1, further comprising:

an alignment notch on the cartridge;

a receiving notch on the main body; and the alignment notch on the cartridge detachably connecting into the receiving notch on the main body.

13. The all-in-one oral care system of claim 1, further comprising a tongue scraper on the toothbrush head.

14. The all-in-one oral care system of claim 13, wherein the tongue scraper further comprises a silicone pad and a plurality of raised notches.

15. An all-in-one oral care system, comprising:

a main body;

a toothbrush head;

a bottom cover;

a top cover;

a cartridge;

the main body comprising an actuator, inner walls, a back slot, a body channel, a plurality of protrusions, a cover receiving groove, a personalization piece, a receiving notch, and a neck connector;

the actuator being made from a resilient material;

the toothbrush head comprising an arm, a tab, a toothbrush channel, an over-molded valve, a nozzle, a plurality of brushing bristles, a tongue scraper, and a receiving hole;

the bottom cover comprising a bottom hole, a snap-on provision, a visual window, an extended window piece, and a plurality of attachment grooves;

the top cover comprising a raised surface, a plurality of ventilation holes, a receptacle, an interdental brush, and a receiving slot;

the cartridge comprising a cartridge gasket, a cartridge body, a cap, a plunger, toothpaste, an alignment notch, and a cap hole;

the cartridge gasket further comprising a cartridge nozzle;

the plunger further comprising an outer wall and a shaped top;

the bottom cover comprising a hollow interior sized to accommodate the cartridge;

wherein the tab snaps into the back slot on the main body;

the extended window piece detachably connecting into the receiving slot on the top cover;

the personalization piece detachably connecting into the receiving slot on the top cover;

the alignment notch on the cartridge detachably connecting into the receiving notch on the main body;

the main body being detachably connected to the toothbrush head, wherein the neck connector slides into the receiving hole;

the main body being detachably connected to the bottom cover, wherein the plurality of protrusions on the main body slot into the plurality of attachment grooves on the bottom cover;

the top cover being detachably connected to the bottom cover, wherein the raised surface of the top cover snaps into the snap-on provision of the bottom cover.

16. The all-in-one oral care system of claim 15, further comprising:

the body channel being the same circumference as the cartridge nozzle;

the actuator is in contact with the body channel; and the tongue scraper comprising a silicone pad and a plurality of raised notches.

17. The all-in-one oral care system of claim 16, wherein:

the interdental brush further comprises flanges; and the flanges of the interdental brush detachably connecting into the receptacle of the top cover.

18. An all-in-one oral care system, comprising:

a main body;

a toothbrush head;

a bottom cover;

a top cover;

a cartridge;

the main body comprising an actuator, inner walls, a back slot, a body channel, a plurality of protrusions, a cover receiving groove, a personalization piece, a receiving notch, and a neck connector;

the toothbrush head comprising an arm, a tab, a toothbrush channel, an over-molded valve, a nozzle, a plurality of brushing bristles, a tongue scraper, and a receiving hole;

the tongue scraper comprising a silicone pad and a plurality of raised notches;

the bottom cover comprising a bottom hole, a snap-on provision, a visual window, an extended window piece, and a plurality of attachment grooves;

the top cover comprising a raised surface, a plurality of ventilation holes, a receptacle, an interdental brush, and a receiving slot;

the cartridge comprising a cartridge gasket, a cartridge body, a cap, a plunger, toothpaste, an alignment notch, and a cap hole;

the cartridge gasket further comprising a cartridge nozzle;

the plunger further comprising an outer wall and a shaped top;

the bottom cover comprising a hollow interior sized to accommodate the cartridge;

the inner walls of the main body being made of over-molded silicone and forming the body channel;

wherein the tab snaps into the back slot on the main body;

the actuator being in contact with the body channel;

the extended window piece detachably connecting into the receiving slot on the top cover;

the personalization piece detachably connecting into the receiving slot on the top cover;

the body channel being the same circumference as the cartridge nozzle;

the actuator being in contact with the body channel;

the interdental brush further comprising flanges;

the flanges of the interdental brush detachably connecting into the receptacle of the top cover;

the alignment notch on the cartridge detachably connecting into the receiving notch on the main body;

the main body being detachably connected to the toothbrush head, wherein the neck connector slides into the receiving hole;

the main body being detachably connected to the bottom cover, wherein the plurality of protrusions on the main body slot into the plurality of attachment grooves on the bottom cover;

the top cover being detachably connected to the bottom cover, wherein the raised surface of the top cover snaps into the snap-on provision of the bottom cover.

* * * * *